US009564692B2

(12) United States Patent
Kanagawa

(10) Patent No.: US 9,564,692 B2
(45) Date of Patent: Feb. 7, 2017

(54) CONDUCTIVE MEMBER

(71) Applicant: SUMITOMO WIRING SYSTEMS, LTD., Yokkaichi, Mie (JP)

(72) Inventor: Shuichi Kanagawa, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 14/626,564

(22) Filed: Feb. 19, 2015

(65) Prior Publication Data

US 2015/0255884 A1 Sep. 10, 2015

(30) Foreign Application Priority Data

Mar. 4, 2014 (JP) ..... 2014-041307

(51) Int. Cl.

| | |
|---|---|
| ***H01R 4/00*** | (2006.01) |
| ***H01R 4/60*** | (2006.01) |
| *H01R 11/12* | (2006.01) |
| *H01R 11/28* | (2006.01) |

(52) U.S. Cl.

CPC ..... *H01R 4/60* (2013.01); *H01R 11/12* (2013.01); *H01R 11/288* (2013.01)

(58) Field of Classification Search

CPC ..... H01R 4/00; H01R 4/60
USPC ..... 174/74 R, 68.2
See application file for complete search history.

(56) References Cited

FOREIGN PATENT DOCUMENTS

| | | | |
|---|---|---|---|
| CN | 2469593 | * | 1/2002 |
| CN | 2469593 Y | * | 1/2002 |
| CN | 201188511 | * | 1/2009 |
| CN | 201188511 Y | * | 1/2009 |
| JP | 2006-174619 A | | 6/2006 |

* cited by examiner

*Primary Examiner* — Timothy Thompson
*Assistant Examiner* — Charles Pizzuto
(74) *Attorney, Agent, or Firm* — Oliff PLC

(57) ABSTRACT

A conductive member is formed using a pipe member made of a conductive metal. The conductive member has a conductive body portion that extends in the lengthwise direction and that forms an electrical conduction path, and an insulating layer formed on the outer circumferential surface. Also, a terminal portion that enables connection with a partner member is integrally formed in each of the two end portions of the conductive body portion. The terminal portions are formed so as to be flat and are provided with a connection hole so as to enable connection with an electrode of an auxiliary battery or a terminal of a DC/DC converter.

10 Claims, 2 Drawing Sheets

CONDUCTIVE MEMBER

TECHNICAL FIELD

The present disclosure relates to a conductive member.

BACKGROUND ART

The supply of electricity to (e.g., the charging of) a 12 V battery (auxiliary battery) installed in a hybrid vehicle, for example, has been controlled by lowering the voltage of high-voltage electricity from the main battery for motor driving using a DC/DC converter, and then supplying the reduced-voltage electricity from the main battery to the auxiliary battery.

JP 2006-174619A is an example of related art.

Conventionally, the auxiliary battery and the DC/DC converter have been connected to each other by an electrical wire with terminals attached at the two ends. When making a connection using such an electrical wire provided with terminals, the connection locations include not only the connections with the battery and the converter, but also the connections between the electrical wire and the terminals, thus raising the number of factors that reduce connection reliability.

There are also cases where the DC/DC converter is installed in the rear side of the vehicle, and the auxiliary battery is installed in the engine room. In these cases, it is common for the electrical wire connecting the two to be laid under the floor of the vehicle, and the electrical wire needs to be passed through a protector in order to be held in a predetermined route (route restriction). However, taking this sort of measure requires members such as a protector and holding clamps for holding the protector to the vehicle body, and thus has the risk of leading to a reduction in work efficiency and an increase in cost.

SUMMARY OF THE INVENTION

An object, for example, of the present disclosure is to provide a conductive member that is superior in terms of contact reliability and that can inexpensively realize route restriction with an improvement in work efficiency.

A first aspect of a conductive member according to exemplary embodiments is a conductive member formed using a pipe member made of a conductive metal, the conductive member includes: a conductive body portion that extends in a lengthwise direction and that forms an electrical conduction path; and a terminal portion that is integrally formed in at least one end portion of the conductive body portion and that enables connection with a partner member.

Conventionally, terminal fittings are connected to the ends of an electrical wire. In contrast, according to exemplary embodiments, it is possible to reduce the number of connection locations by forming the conductive body portion, corresponding to the electrical wire, and the terminal portions, corresponding to the terminal fittings, in an integrated manner. This makes it possible to increase connection reliability.

Also, because the conductive member, according to exemplary embodiments, has a predetermined three-dimensional shape, the conductive member can hold a predetermined bent shape on its own. Thus, the conductive member does not require the use of a protector, clamps, or the like, as is commonly required in conventional technology, in order to hold the predetermined three-dimensional bent shape. The embodiments of the present disclosure can therefore inexpensively realize route restriction, and can improve work efficiency as well.

EMBODIMENTS OF THE INVENTION

The following describes exemplary embodiments. Other embodiments will be apparent to those skilled in the art from consideration of the disclosure.

(1) In exemplary embodiments, the conductive member is configured such that an insulating layer is formed on an outer circumferential surface of the conductive body portion.

According to this configuration, the insulation of the conductive member is ensured by the insulating layer.

(2) Also, in exemplary embodiments, the conductive member is configured such that the terminal portion includes flat portions, formed by collapsing two end portions of the pipe member, and connection portions, which are formed in the flat portions and enable connection with the partner member.

According to this configuration, the flat portion of the terminal portion is formed by collapsing the pipe member, thus facilitating close contact when the connection location on the partner member is flat. This makes it possible to increase connection reliability.

(3) Furthermore, a collapsed area may be formed in the conductive body portion by collapsing a predetermined range in the lengthwise direction of the conductive body portion.

According to this configuration, the conductive body portion has a collapsed area over a predetermined length range, thus making it possible to arrange a conductive member that reduces space in the collapsing direction.

Figure 1:
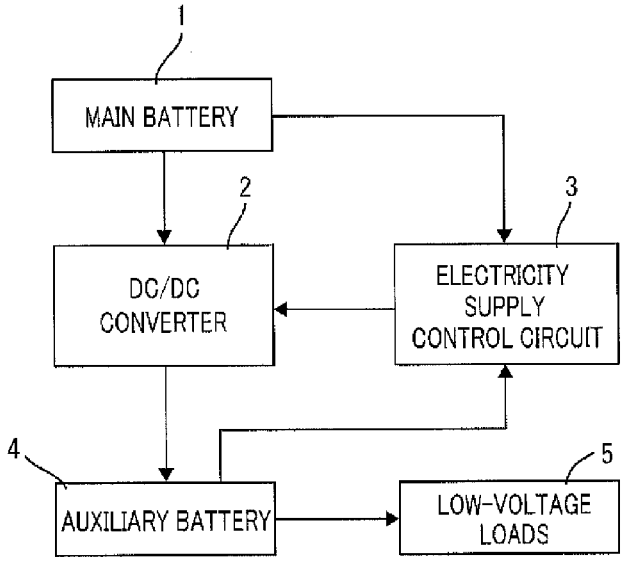
FIG. 1 is a block diagram showing a system for supplying electricity to an auxiliary battery according to an exemplary embodiment.

FIG. 1 is a schematic block diagram of a system for supplying electricity to an auxiliary battery (12 V battery) for installation in a hybrid vehicle, according to exemplary embodiments. The system for supplying electricity to an auxiliary battery 4 is configured to include a main battery 1, a DC/DC converter 2, an electricity supply control circuit 3, and the auxiliary battery 4.

As shown in FIG. 1, based on an instruction from the electricity supply control circuit 3 and when the vehicle is in a battery travel mode, the main battery 1 supplies electricity having a high battery voltage, for example voltage of about 200 V, to the DC/DC converter 2, and supplies driving electricity to a traveling motor (not shown) via an inverter (not shown). The electricity supply control circuit 3 detects the battery voltage and the battery temperature of the main battery 1, detects the battery voltage of the auxiliary battery 4, and controls operation of the DC/DC converter 2 and the like based on the detected data and the like.

The auxiliary battery 4 is a 12 V battery, for example, and supplies electricity to various types of low-voltage loads 5 (e.g., a navigation apparatus, an air conditioner, and/or headlights) provided in the vehicle.

Figure 2:
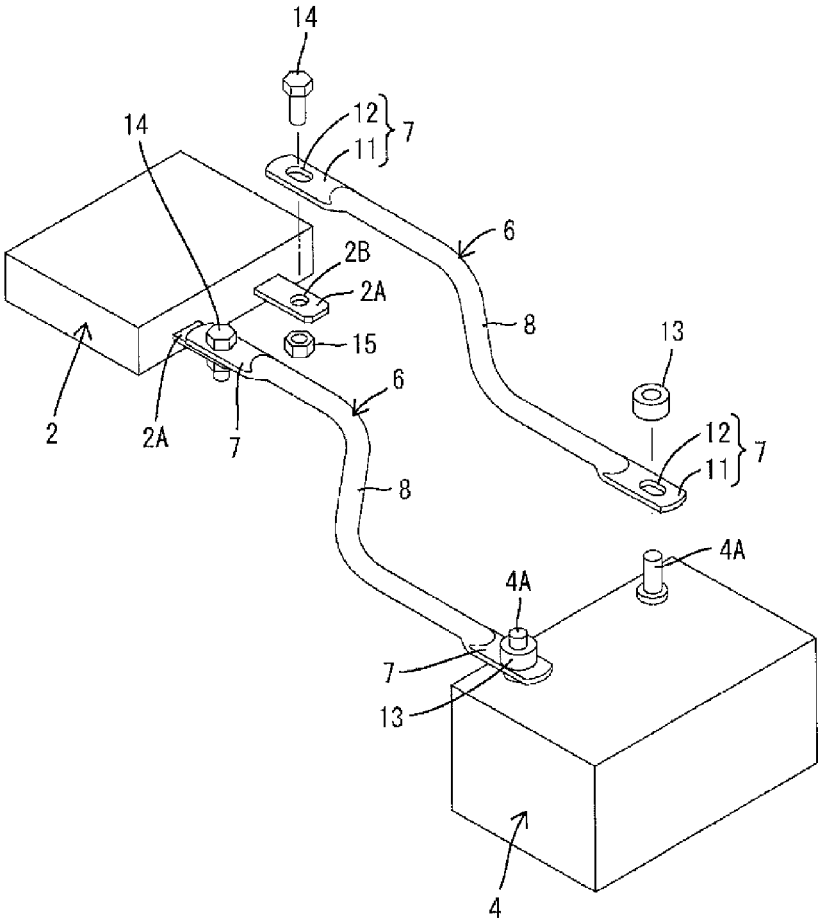
FIG. 2 is a perspective view of connections between an auxiliary battery and a DC/DC converter according to an exemplary embodiment.

FIG. 2 shows connections between the DC/DC converter 2 and the auxiliary battery 4. Multiple terminals 2A (only two are shown in FIG. 2) protrude from the DC/DC converter 2. A circular junction hole 2B is formed as a through-hole in each of the terminals 2A. A pair of electrodes 4A (a positive electrode and a negative electrode), which are formed with an approximately columnar shape, protrude from the upper surface of the auxiliary battery 4. The terminals 2A and the electrodes 4A are connected to each other by two conductive members 6.

Figure 3:
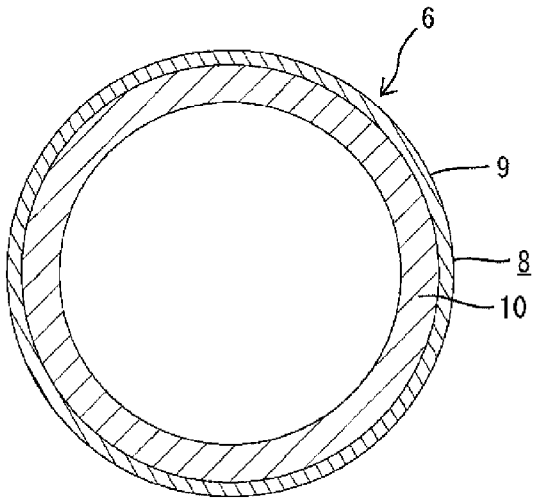
FIG. 3 is a cross-sectional view of a conductive body portion of a conductive member according to an exemplary embodiment.

Each of the conductive members 6 is made of a conductive metal, and is formed as a single body using a pipe member that has a circular cross-section. The conductive member 6 includes terminal portions 7 provided at its two ends, and a conductive body portion 8 formed between the two terminal portions 7. As shown in FIG. 3, the conductive body portion 8 is formed so as to have a circular cross-section over approximately the entire length thereof. Additionally, the conductive body portion 8 includes a conductive layer 10 and an insulating layer 9. The insulating layer 9 is made of a synthetic resin and is formed on an outer circumferential surface of the conductive layer 10. As shown in FIG. 2, intermediate portions of the conductive body portion 8 are bent, and the conductive body portion 8 holds a predetermined bent shape. This preformed bending is achieved using a bending device that does not collapse the bent portions.

Figure 4:
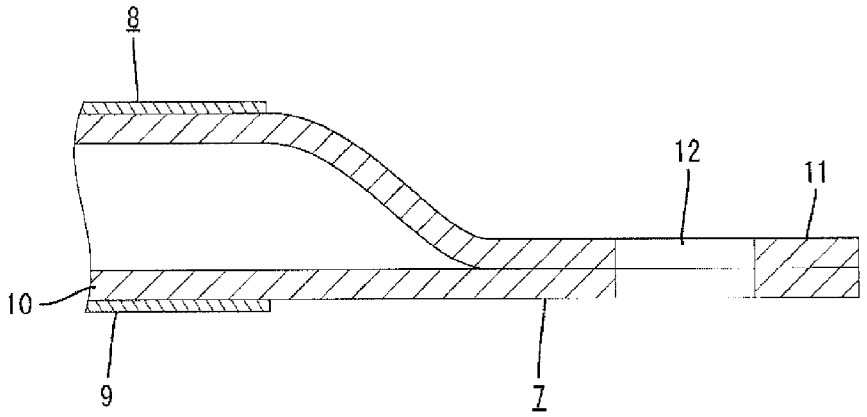
FIG. 4 is a cross-sectional view of a terminal portion of the conductive member according to an exemplary embodiment.

As shown in FIG. 4, each of the two terminal portions 7 is formed by collapsing an upper surface side of the circular pipe member until it comes into close contact with a lower surface side of the pipe member. Accordingly, each of the two terminal portions 7 is provided with a flat portion 11 that has been collapsed into a flat shape according to which the lower surface of the terminal portion 7 is substantially flush with the lower surface of the conductive body portion 8. Also, a connection hole 12, which serves as a connection portion, is formed as a through-hole in the flat portion 11 of each of the two terminal portions 7. The connection holes 12 can be substantially aligned with and put in communication with the junction holes 2B in the terminals 2A of the DC/DC converter 2. Additionally, the connections holes 12 are formed such that the electrodes 4A of the auxiliary battery 4 can be inserted therein.

Note that in exemplary embodiments, the connection holes 12 are each shaped as an elongated hole that extends in a direction parallel to the lengthwise direction of the conductive member 6. As shown in FIG. 4, the insulating layer 9 is removed from the terminal portions 7, and the conductive layer 10 is exposed over the entire surface of the terminal portions 7.

The following describes advantages and effects of the exemplary embodiments. The auxiliary battery 4 and the DC/DC converter 2 are connected by the conductive members 6 in the following manner.

Specifically, the connection hole 12 of one of the terminal portions 7 of one of the two conductive members 6 is fitted around one of the electrodes 4A of the auxiliary battery 4 and fastened thereto using a nut 13. The other terminal portion 7 of the conductive member 6 is placed over the corresponding terminal 2A of the DC/DC converter 2, and the connection hole 12 and the junction hole 2B are aligned with each other. Even if there is a certain amount of misalignment in the lengthwise direction of the conductive member 6 at this time, the connection hole 12 and the junction hole 2B can be aligned with each other because the connection hole 12 is an elongated hole and effectively absorbs the misalignment. A bolt 14 is inserted through the junction hole 2B and the connection hole 12 in the aligned state and fastened from the opposite side using a nut 15, thus connecting the terminal portion 7 and the terminal 2A. The other conductive member 6 is then also connected to the auxiliary battery 4 and the DC/DC converter 2, thus completing the task of connecting the auxiliary battery 4 and the DC/DC converter 2.

The following describes advantages and effects of the exemplary embodiments. Since the conductive body portion 8 and the terminal portion 7 of the conductive member 6 are formed in an integrated manner, the number of connection locations can be reduced compared to conventional modes, in which terminals are connected to an electrical wire. Thus, it is possible to increase connection reliability, compared to the conventional modes. Also, because the conductive member 6 is formed using a pipe member, it can be bent into a predetermined layout shape in advance and can hold that shape. The task of arranging electrical wires can therefore be performed easily. Also, because conductive member 6 is formed using a pipe member, it is possible to obtain a higher shape holding ability, compared to conventional members that are formed using a plate material. Accordingly, there is no need to form the conductive member 6 with reinforcing structures such as ribs, which are required when the member is formed of a plate material.

Electrical wires themselves are flexible, and therefore they cannot hold a predetermined layout shape on their own. It is thus laborious to insert electrical wires through a protector (exterior member) such as a corrugated tube, and many holding clamps are needed to fix the protector to the vehicle body. In this respect, the conductive member 6, according to exemplary embodiments, can hold its formed shape on its own, and thus the exterior member can be omitted. Additionally, the number of members needed for holding the conductive member 6 can be reduced, thus making it possible to improve work efficiency and reduce cost.

Furthermore, since the insulating layer 9 is formed on the outer circumferential surface of the conductive body portion 8 of the conductive member 6, there is no risk of a short. This insulating layer 9 can be easily formed by performing, coating, or molding.

Moreover, positional misalignment of the conductive body portion 8 during connection to the DC/DC converter 2 or the auxiliary battery 4 can be effectively absorbed by forming the connection hole 12 as an elongated hole.

Figure 5:
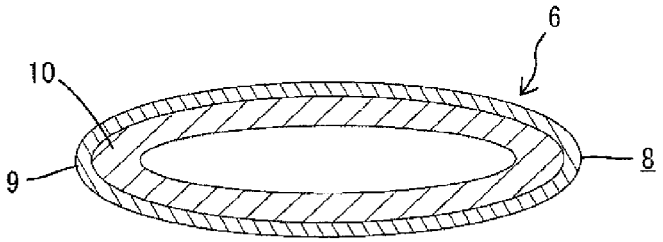
FIG. 5 is a cross-sectional view of a collapsed area of a conductive body portion according to an exemplary embodiment.

Although in the above described exemplary embodiments the conductive member 6 connects the auxiliary battery 4 and the DC/DC converter 2, the conductive member 6 may connect the main battery 1 and an inverter, for example. Conventionally, the main battery 1 and the inverter in a hybrid vehicle are connected via a long routing pathway that extends under the floor from the rear side of the vehicle to the interior of the engine room. It has been known that a sufficient amount of space in the height direction cannot be ensured for the conventional routing pathway. In the case of applying the conductive member 6, according to exemplary embodiments, to this routing pathway, a predetermined length range of the conductive body portion 8 is collapsed in the height direction (the up-down direction in FIG. 5) to form a collapsed area. Thus, the collapsed are reduces the height needed for the installation space of the conductive member 6.

The present invention is not limited to the embodiments described above with reference to the drawings, and embodiments such as the following examples are also encompassed in the technical scope of the present disclosure.

(1) Although the conductive member 6 of the above exemplary embodiments is formed using a circular pipe, it may be obtained by processing a square pipe.

(2) Although the above exemplary embodiments describe a mode of connection by forming the connection hole 12 as a through-hole serving as the connection portion, a mode is possible in which the connection hole 12 is not formed, and connection with the partner member is performed using the original tab shape.

(3) Although the terminal portions 7 at the two ends of the conductive member 6 have the same shape in the above exemplary embodiments, they may have different shapes according to the mode of the connection partner.

LIST OF REFERENCE NUMERALS

2 DC/DC converter
4 Auxiliary battery
6 Conductive member
7 Terminal portion
8 Conductive body portion
9 Insulating layer
11 Flat portion
12 Connection hole (connection portion)

What is claimed is:

1. A conductive member formed using a hollow pipe member made of a conductive metal, the conductive member comprising:
- a conductive body portion extending in a lengthwise direction and forming an electrical conduction path, the conductive body portion including at least one collapsed portion disposed within a middle region of the conductive body portion; and
- a terminal portion integrally formed in at least one end portion of the conductive body portion, the terminal portion enabling connection with a partner member.

2. The conductive member according to claim 1, wherein an insulating layer is formed on an outer circumferential surface of the conductive body portion.

3. The conductive member according to claim 1, wherein the terminal portion includes:
- flat portions formed by collapsing two end portions of the hollow pipe member, and
- a hole formed in the flat portions and that enable connection with the partner member.

4. The conductive member according to claim 3, wherein
- one flat portion of the terminal portion extends flatly and continuously to a conductive layer in the conductive body portion, and
- another flat portion of the terminal portion is bent towards the conductive layer in the conductive body portion.

5. The conductive member according to claim 1, wherein a collapsed area is formed in the conductive body portion by collapsing the conductive body portion in a predetermined range along the lengthwise direction.

6. An electrical connection system comprising:
- a DC/DC converter;
- a battery; and
- a conductive member formed of a hollow pipe member made of a conductive metal, the conductive member including:
  - a conductive body portion extending in a lengthwise direction and forming an electrical conduction path, the conductive body portion including at least one collapsed portion disposed within a middle region of the conductive body portion, and
  - at least two terminal portions integrally formed in at least one end portion of the conductive body portion, one terminal portion being electrically connected to the DC/DC converter and the other terminal portion being electrically connected to the battery.

7. The conductive member according to claim 6, wherein an insulating layer is formed on an outer circumferential surface of the conductive body portion.

8. The conductive member according to claim 6, wherein each terminal portion includes:
- flat portions formed by collapsing two end portions of the hollow pipe member, and
- a hole formed in the flat portions and that enable electrical connection to the DC/DC converter or the battery, respectively.

9. The conductive member according to claim 8, wherein
- one flat portion of the terminal portion extends flatly and continuously to a conductive layer in the conductive body portion, and
- another flat portion of the terminal portion is bent towards the conductive layer in the conductive body portion.

10. The conductive member according to claim 6, wherein a collapsed area is formed in the conductive body portion by collapsing the conductive body portion in a predetermined range along the lengthwise direction.

* * * * *